US009937729B2

(12) United States Patent
Nishimura et al.

(10) Patent No.: US 9,937,729 B2
(45) **Date of Patent: *Apr. 10, 2018**

(54) THERMAL PRINT HEAD

(71) Applicant: ROHM CO., LTD., Kyoto-shi, Kyoto (JP)

(72) Inventors: Isamu Nishimura, Kyoto (JP); Yasuhiro Fuwa, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/386,884

(22) Filed: Dec. 21, 2016

(65) Prior Publication Data

US 2017/0182794 A1 Jun. 29, 2017

(30) Foreign Application Priority Data

Dec. 25, 2015 (JP) ..... 2015-254021

(51) Int. Cl.
*B41J 2/335* (2006.01)
*B41J 2/34* (2006.01)

(52) U.S. Cl.
CPC ..... *B41J 2/33595* (2013.01); *B41J 2/3351* (2013.01); *B41J 2/3353* (2013.01); *B41J 2/3354* (2013.01); *B41J 2/3355* (2013.01); *B41J 2/3357* (2013.01); *B41J 2/33515* (2013.01); *B41J 2/33525* (2013.01); *B41J 2/33535* (2013.01); *B41J 2/33545* (2013.01); *B41J 2/34* (2013.01)

(58) Field of Classification Search
CPC ..... B41J 2/335
See application file for complete search history.

(56) References Cited

U.S. PATENT DOCUMENTS 5,041,847 A * 8/1991 Matsumoto ..... B41J 2/3353 347/205
2002/0066478 A1* 6/2002 Hayashi ..... H01L 31/0236 136/244
2005/0174052 A1* 8/2005 Niigaki ..... H01J 1/34 313/530
2011/0285803 A1* 11/2011 Aso ..... B41J 2/335 347/218

FOREIGN PATENT DOCUMENTS

JP 58166072 A * 10/1983 ..... B41J 2/335
JP 61171366 A * 8/1986 ..... B41J 2/335
JP 61262144 A * 11/1986 ..... B41J 2/335
JP 63122576 A * 5/1988 ..... B41J 2/335
JP 2012-51319 A 3/2012

* cited by examiner

*Primary Examiner* — Shelby Fidler
(74) *Attorney, Agent, or Firm* — Hamre, Schumann, Mueller & Larson, P.C.

(57) ABSTRACT

A thermal print head includes a semiconductor substrate, a resistor layer and a wiring layer. The resistor layer is formed on the semiconductor substrate and has a plurality of heat generating portions arranged in the main scanning direction. The wiring layer is formed on the semiconductor substrate to be included in a conduction path for energizing the plurality of heat generating portions. The conduction path includes a path or paths provided by the semiconductor substrate itself.

35 Claims, 14 Drawing Sheets

THERMAL PRINT HEAD

BACKGROUND OF THE INVENTION

1. Field of the Invention

The present invention relates to a thermal print head.

2. Description of the Related Art

A conventionally known thermal print head includes a substrate, a resistor layer, and a wiring layer. Such a thermal print head is disclosed in JP-A-2012-51319, for example. In the thermal print head disclosed in this patent publication, the resistor layer and the wiring layer are formed on the substrate. The resistor layer has a plurality of heat generating portions arranged in a main scanning direction.

To realize fine printing, the pitch of the heat generating portions needs to be reduced. To reduce the pitch, the wiring layer needs to be formed into a fine pattern.

SUMMARY OF THE INVENTION

The present invention has been proposed under the above circumstances, and an object thereof is to provide a thermal print head capable of realizing fine printing.

According to an aspect of the present invention, there is provided a thermal print head including: a semiconductor substrate; a resistor layer formed on the semiconductor substrate and having a plurality of heat generating portions arranged in a main scanning direction; and a wiring layer formed on the semiconductor substrate and included in a conduction path for energizing the plurality of heat generating portions. The conduction path includes the semiconductor substrate.

According to the present invention, the conduction path for energizing the heat generating portions includes one or more paths provided by the semiconductor substrate itself. Thus, the total area of the wiring layer to be disposed on the obverse surface of the substrate can be reduced. Accordingly, it is possible to ensure that a larger area is allotted for the remaining portions of the wiring layer on the obverse surface. As a result, the remaining portions of the wiring layer can be arranged with a greater degree of freedom, which facilitates the downsizing and pitch-narrowing of the heat generating portions without compromising the proper conduction of the wiring layer on the obverse surface. As such, fine printing will also be achieved.

Further features and advantages of the present invention will become apparent from the following detailed description with reference to the attached drawings.

DESCRIPTION OF THE PREFERRED EMBODIMENTS

Figure 1:
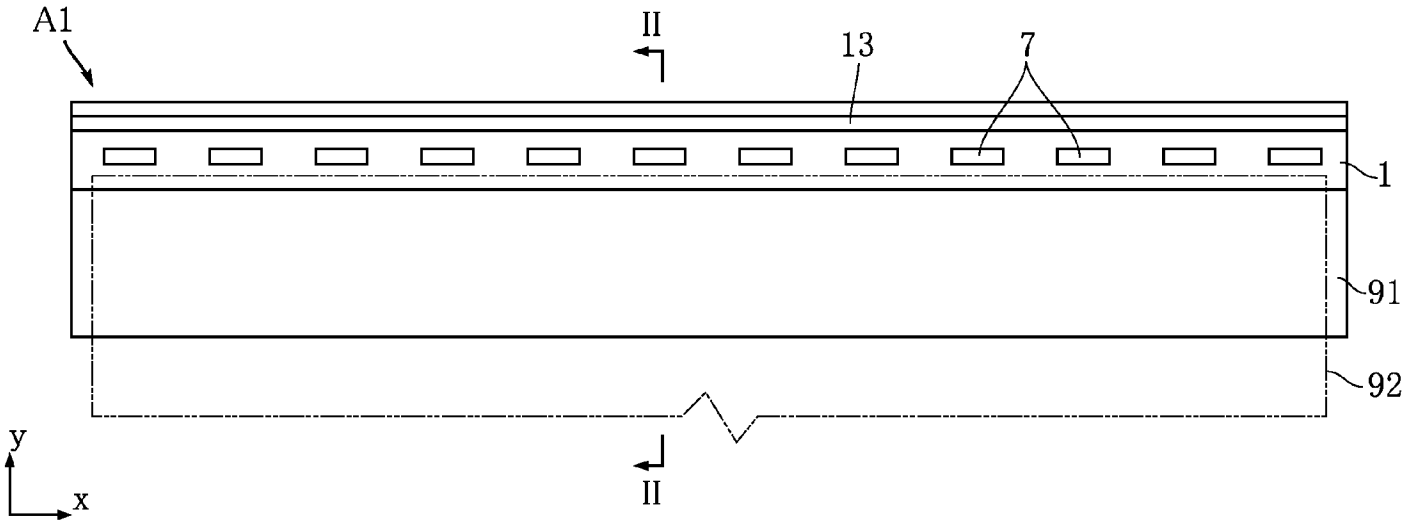
FIG. 1 is a plan view showing a thermal print head according to a first embodiment of the present invention.

Hereinafter, preferred embodiments of the present invention will be described in detail with reference to the drawings.

FIGS. 1 to 4 show a thermal print head according to a first embodiment of the present invention. A thermal print head A1 of the present embodiment includes a semiconductor substrate 1, an insulation layer 2, a wiring layer 3, a resistor layer 4, an insulating protective layer 5, a conductive protective layer 6, a plurality of control elements 7, a protective resin 8, a supporting member 91, and a wiring member 92. The thermal print head A1 is incorporated in a printer that performs printing on a printing medium 992 which is conveyed in the state of being sandwiched between the thermal print head A1 and a platen roller 991. Examples of the printing medium 992 include thermal sheets which are used to create barcode sheets and receipts.

Figure 2:
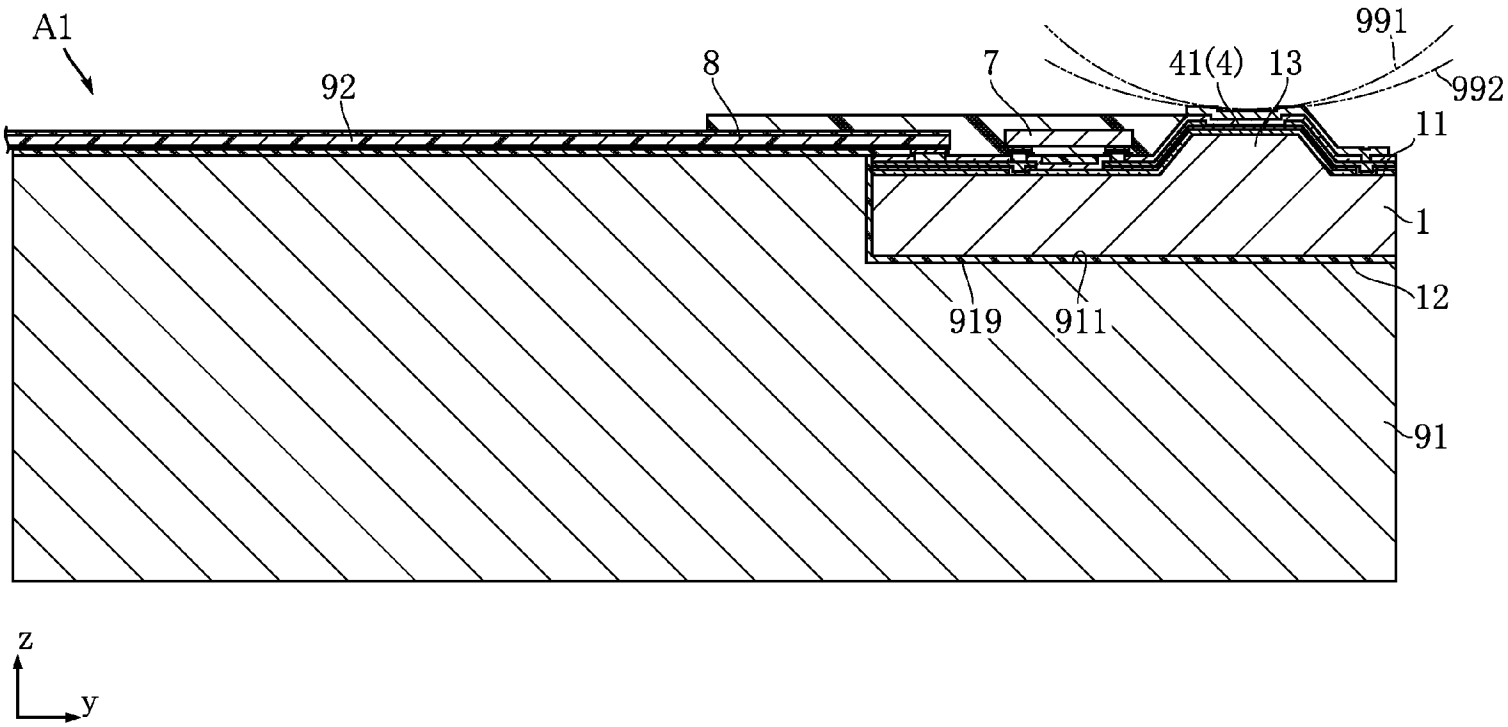
FIG. 2 is a cross-sectional view along the line II-II in FIG. 1.
Figure 3:
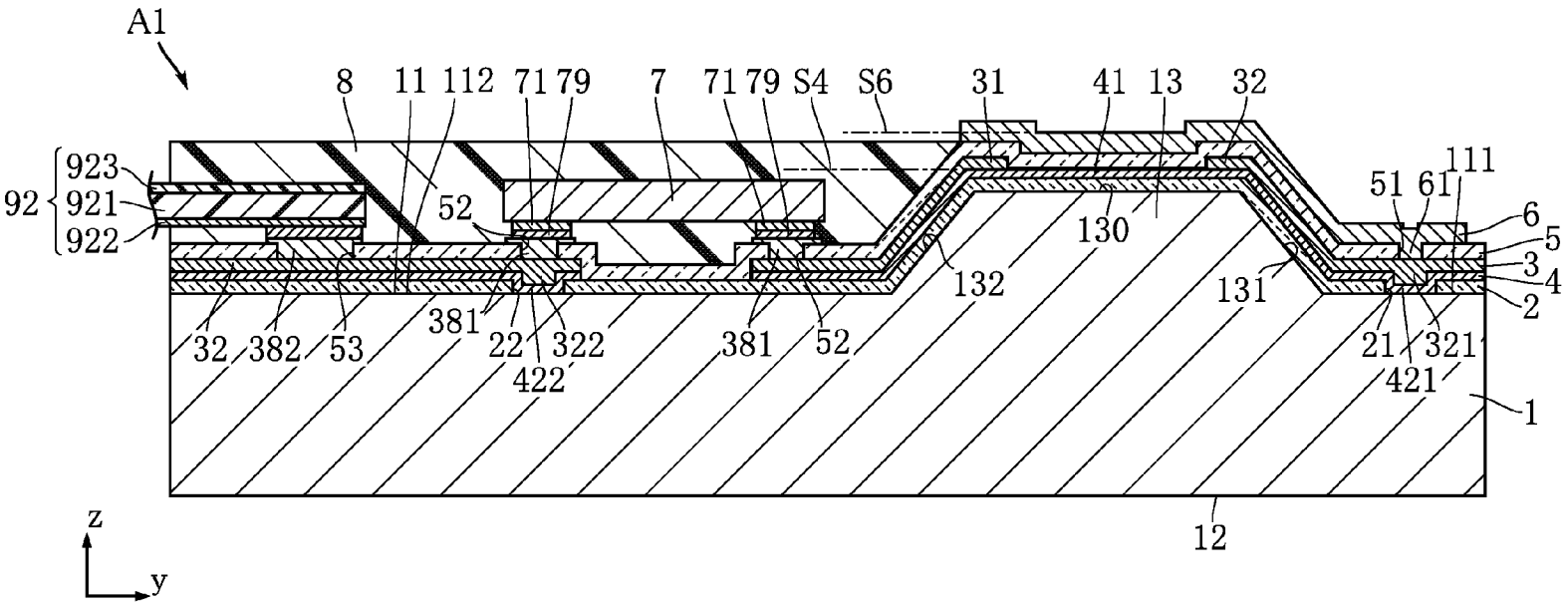
FIG. 3 is an enlarged cross-sectional view showing a main part of the thermal print head in FIG. 1.
Figure 4:
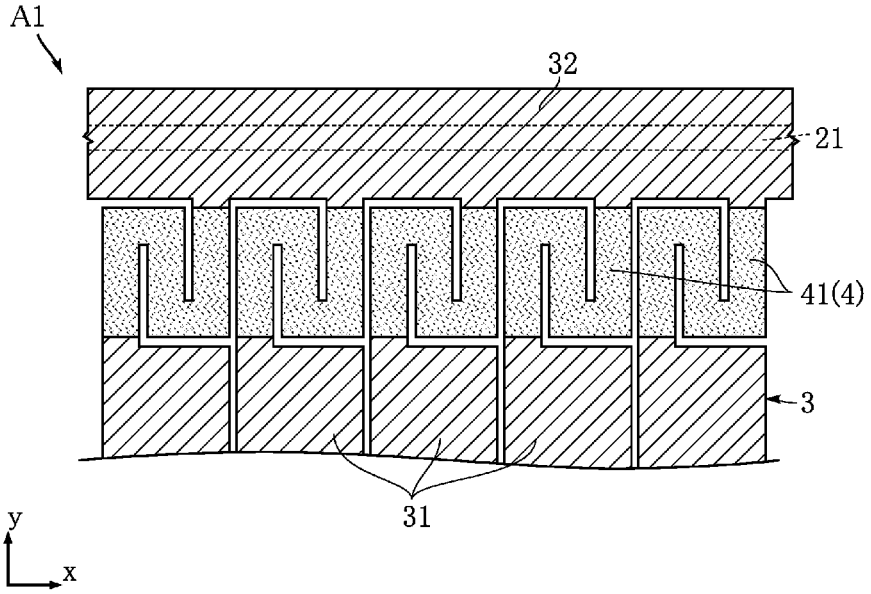
FIG. 4 is an enlarged plan view showing a main part of the thermal print head in FIG. 1.
Figure 5:
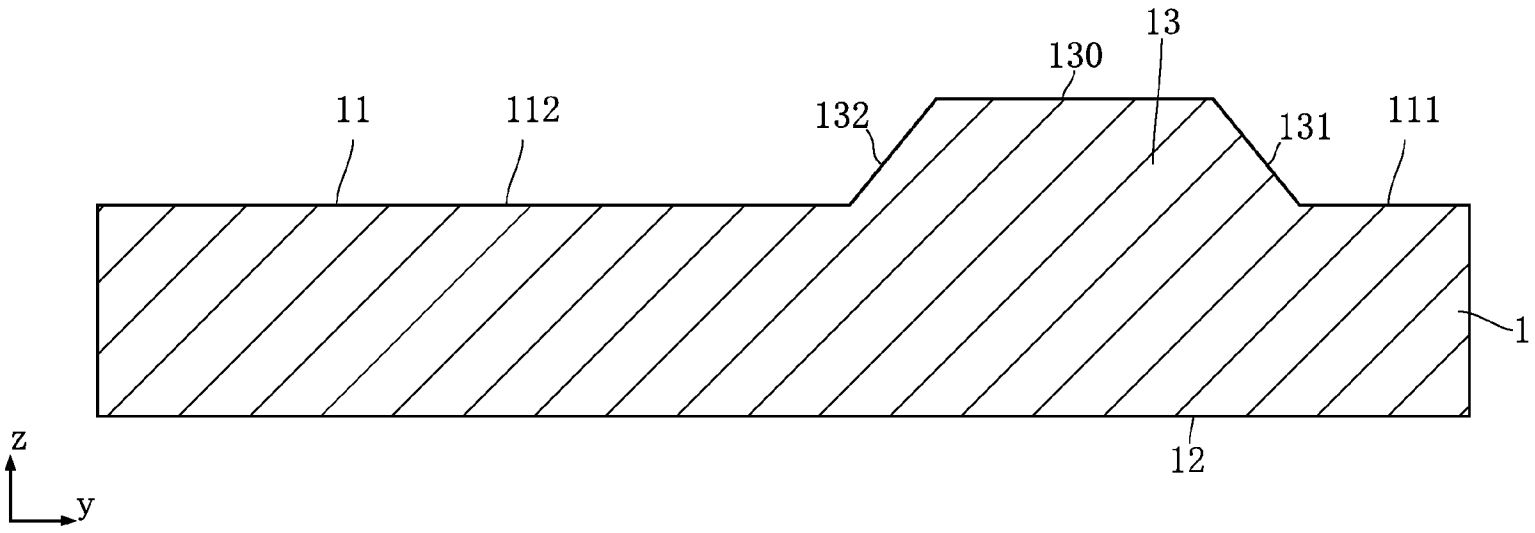
FIG. 5 is an enlarged cross-sectional view showing an example of a method for manufacturing the thermal print head in FIG. 1.

FIG. 1 is a plan view showing the thermal print head A1. FIG. 2 is a cross-sectional view along the line II-II in FIG. 1. FIG. 3 is an enlarged cross-sectional view showing a main part of the thermal print head A1. FIG. 4 is an enlarged cross-sectional view showing a main part of the thermal print head A1. To facilitate understanding, the supporting member 91 is omitted in FIG. 3. FIG. 4 shows a part of the thermal print head A1.

The semiconductor substrate 1 is made of a semiconductor material having a resistivity that allows for conduction. Examples of such a semiconductor material include Si doped with a metallic element. The semiconductor substrate 1 has an obverse surface 11, a reverse surface 12, and a projection 13. The semiconductor substrate 1 may not include the projection 13.

The obverse surface 11 and the reverse surface 12 face away from each other in a thickness direction z. The projection 13 projects from the obverse surface 11 in the thickness direction z. The projection 13 is elongated in a main scanning direction x.

The obverse surface 11 has a first region 111 and a second region 112, which are spaced apart from each other in a sub-scanning direction with the projection 13 therebetween.

The projection 13 has a top surface 130, a first inclined side surface 131, and a second inclined side surface 132. The top surface 130 is parallel to the obverse surface 11, and is spaced apart from the obverse surface 11 in the thickness direction. The first inclined side surface 131 is located between the top surface 130 and the first region 111, and is inclined relative to the obverse surface 11. The second inclined side surface 132 is located between the top surface 130 and the second region 112, and is inclined relative to the obverse surface 11.

In the present embodiment, a (100) surface is selected as the obverse surface 11. In addition, the first inclined side surface 131 and the second inclined side surface 132 form the same angle with the top surface 130 and the obverse surface 11, such as an angle of 54.7°.

The obverse surface 11 has the first region 111 and the second region 112. The first region 111 and the second region 112 are partitioned by the projection 13. In the present embodiment, the second region 112 is larger than the first region 111 in dimension in the sub-scanning direction y and area.

The semiconductor substrate 1 is not particularly limited in terms of dimensions, and may have dimensions of approximately 2.0 mm to 3.0 mm in the sub-scanning direction y and approximately 100 mm to 150 mm in the direction x. The distance between the obverse surface 11 and the reverse surface 12 in the thickness direction z is approximately 400 μm to 500 μm, and the height of the projection 13 in the thickness direction z is approximately 250 μm to 400 μm.

The insulation layer 2 is arranged between a group of the obverse surface 11 and projection 13 of the semiconductor substrate 1 and a group of the wiring layer 3 and the resistor layer 4. The insulation layer 2 is made of an insulation material, such as $SiO_2$ or SiN. The insulation layer 2 is not particularly limited in terms of thickness, and may have a thickness of approximately 5 μm to 10 μm, for example.

The insulation layer 2 has a common-electrode first opening 21 and a common-electrode second opening 22. The common-electrode first opening 21 extends through the insulation layer 2 in the thickness direction z. In the present embodiment, the common-electrode first opening 21 overlaps with the first region 111 as viewed in the thickness direction z. The common-electrode first opening 21 is elongated in the main scanning direction x, and may be a slit, for example.

The common-electrode second opening 22 extends through the insulation layer 2 in the thickness direction z. In the present embodiment, the common-electrode second opening 22 overlaps with the second region 112 as viewed in the thickness direction z.

The resistor layer 4 is supported by the semiconductor substrate 1, and is formed on the insulation layer 2 in the present embodiment. The resistor layer 4 has a plurality of heat generating portions 41. The heat generating portions 41 are individually and selectively energized and thereby heat the printing medium 992 locally. The heat generating portions 41 are arranged along the main scanning direction x. In the present embodiment, the heat generating portions 41 overlap with the projection 13 as viewed in the thickness direction z. More specifically, the heat generating portions 41 overlap entirely with the top surface 130. The resistor layer 4 is made of TaN, for example.

The heat generating portions 41 are not particularly limited in terms of shape. In one example shown in FIG. 4, however, the heat generating portions 41 have a bending shape.

In the present embodiment, the resistor layer 4 has a resistor-side first through-conductive portion 421 and a resistor-side second through-conductive portion 422. The resistor-side first through-conductive portion 421 is in contact with the first region 111 of the obverse surface 11 of the semiconductor substrate 1, via the common-electrode first opening 21. The resistor-side second through-conductive portion 422 is in contact with the second region 112 of the obverse surface 11 of the semiconductor substrate 1, via the common-electrode second opening 22.

The wiring layer 3 forms a conduction path for energizing the heat generating portions 41. The wiring layer 3 is supported by the semiconductor substrate 1, and is stacked on the resistor layer 4 in the present embodiment. Note that the wiring layer 3 may be arranged between the semiconductor substrate 1 and the resistor layer 4. The wiring layer 3 is made of a metallic material having a lower resistance than the resistor layer 4, such as Cu. The wiring layer 3 may have a Cu layer and a Ti layer, where the Ti layer is disposed between the Cu layer and the resistor layer 4.

The wiring layer 3 has a plurality of individual electrodes 31 and a common electrode 32. The plurality of individual electrodes 31 are connected one-to-one to the plurality of heat generating portions 41. In the present embodiment, the plurality of individual electrodes 31 are positioned closer to the second region 112 than the heat generating portions 41 are in the sub-scanning direction y.

The common electrode 32 has a portion located opposite to the plurality of individual electrodes 31 with the heat generating portions 41 therebetween in the sub-scanning direction y. In addition, the common electrode 32 in the present embodiment has a portion located closer to the second region 112 (i.e., in the left side of FIG. 3) than the plurality of individual electrodes 31 in the sub-scanning direction y. The common electrode 32 is electrically connected to all of the heat generating portions 41. To facilitate understanding, FIG. 3 shows a cross section that crosses the common electrode 32 in the second region 112. Note that in a cross section at a different position in the main scanning direction x, the wiring layer 3 has a plurality of insulating portions that each have a different potential from the common electrode 32.

As can be understood from FIGS. 3 and 4, in the present embodiment, the resistor layer 4 includes portions that are exposed from the wiring layer 3 between the plurality of individual electrodes 31 and the common electrode 32, and these exposed portions serve as the heat generating portions 41.

In the present embodiment, the common electrode 32 has a wiring-side first through-conductive portion 321 and a wiring-side second through-conductive portion 322. The wiring-side first through-conductive portion 321 is in contact with the resistor-side first through-conductive portion 421 of the resistor layer 4. The wiring-side second through-conductive portion 322 is in contact with the resistor-side second through-conductive portion 422 of the resistor layer 4. With such a structure, a portion of the common electrode 32 of the wiring layer 3 that overlaps with the first region 111 as viewed in the thickness direction z is electrically connected to the semiconductor substrate 1 via the resistor-side first through-conductive portion 421 in the common-electrode first opening 21 of the insulation layer 2. Also, a portion of the common electrode 32 that overlaps with the second region 112 is electrically connected to the semiconductor substrate 1 via the resistor-side second through-conductive portion 422 in the common-electrode second opening 22 of the insulation layer 2. Accordingly, in the present embodiment, the conduction path for energizing the heat generating portions 41 includes the wiring layer 3 and the semiconductor substrate 1. More specifically, the current flowing through the common electrode 32 passes through the semiconductor substrate 1.

The insulating protective layer 5 covers the wiring layer 3 and the resistor layer 4. The insulating protective layer 5 is made of an insulating material, and protects the wiring layer 3 and the resistor layer 4. The insulating protective layer 5 is made of $SiO_2$, for example.

The insulating protective layer 5 has a conductive-protective-layer opening 51, a plurality of control element openings 52, and a plurality of wiring member openings 53. The conductive-protective-layer opening 51 overlaps with the first region 111 as viewed in the thickness direction z, allowing the common electrode 32 to be exposed. The conductive-protective-layer opening 51 is elongated in the main scanning direction x, for example. In the illustrative example, the conductive-protective-layer opening 51 overlaps with the common-electrode first opening 21 as viewed in the thickness direction z. The control element openings 52 overlap with the second region 112 as viewed in the thickness direction z, allowing the plurality of individual electrodes 31 and the common electrode 32 to be exposed.

The plurality of wiring member openings 53 are arranged opposite to the heat generating portions 41 relative to the control element openings 52 in the sub-scanning direction y. The plurality of wiring member openings 53 allow the common electrode 32 of the wiring layer 3 and other portions of the wiring layer 3 to be exposed. Specifically, the other portions of the wiring layer 3 are arranged at positions different from the position of the common electrode 32, and are insulated from the common electrode 32.

The conductive protective layer 6 overlaps with the plurality of heat generating portions 41 as viewed in the thickness direction z and is stacked on the insulating protective layer 5. The conductive protective layer 6 is made of a conductive material, such as AlN. The conductive protective layer 6 has a portion overlapping with the first region 111 as viewed in the thickness direction z, and has a protective layer through-conductive portion 61. The protective layer through-conductive portion 61 is held in contact with the common electrode 32 via the conductive-protective-layer opening 51.

The plurality of control elements 7 are electrically connected to the wiring layer 3 and individually energize the heat generating portions 41. The plurality of control elements 7 are arranged in the main scanning direction x. The plurality of control elements 7 overlap with the common-electrode second opening 22 as viewed in the thickness direction z.

In the present embodiment, the thermal print head A1 has control element pads 381. The control element pads 381 are made of metal such as Cu or Ni, and are formed in the control element openings 52. The control elements 7 each have a plurality of control element electrodes 71. The control element electrodes 71 are conductively bonded to the control element pads 381 with a conductive bonding material 79. The conductive bonding material 79 is solder, for example.

In the present embodiment, the control elements 7 are located closer to the semiconductor substrate 1 in the thickness direction z than a conductive protective layer surface S6 which is an upper surface of the conductive protective layer 6 in the thickness direction z. In addition, the control elements 7 are located closer to the semiconductor substrate 1 in the thickness direction z than a resistor layer surface S4 which is an upper surface of the resistor layer 4 in the thickness direction z.

The wiring member 92 electrically connects the wiring layer 3 to, for example, a power supply unit (not shown) of a printer. The wiring member 92 is a printed wiring board, for example. The wiring member 92 as described above has a resin layer 921, a wiring layer 922, and a protective layer 923, for example. The resin layer 921 is made of a flexible resin. The wiring layer 922 is stacked on one surface of the resin layer 921, and is made of metal such as Cu. The protective layer 923 is stacked on another surface of the resin layer 921 that is located opposite to the surface on which the wiring layer 922 is stacked. The protective layer 923 protects the resin layer 921 and the wiring layer 922.

The thermal print head A1 has a wiring member pad 382. The wiring member pad 382 is formed in one of the wiring member openings 53 of the insulating protective layer 5, and is made of metal such as Cu or Ni. The wiring layer 922 of the wiring member 92 is conductively bonded to the wiring member pad 382. Note that the thermal print head A1 has more than one wiring member pad 382. The wiring member pad 382 shown in FIG. 3 is electrically connected to the common electrode 32. Some of the plurality of wiring member pads 382 are electrically connected to other portions of the wiring layer 3 that are insulated from the common electrode 32 and that are arranged at positions different from the position shown in FIG. 3.

The supporting member 91 supports the semiconductor substrate 1. The supporting member 91 is made of metal such as A1. The supporting member 91 has a recess 911. The recess 911 accommodates and supports the semiconductor substrate 1. The semiconductor substrate 1 is bonded to the recess 911 with a bonding layer 919, for example. It is preferable that the bonding layer 919 conducts the heat from the semiconductor substrate 1 to the supporting member 91 and insulates the semiconductor substrate 1 from the supporting member 91. Examples of such a bonding layer 919 include resin adhesive.

The supporting member 91 is not particularly limited in terms of dimensions, and may have dimensions of approximately 5.0 mm to 8.0 mm in the sub-scanning direction y, approximately 100 mm to 150 mm in the direction x, and approximately 2.0 mm to 4.0 mm in the thickness direction z.

The protective resin 8 protects the control elements 7, and is made of an insulating resin, for example. In addition, the protective resin 8 overlaps the second inclined side surface 132 of the projection 13 as viewed in the thickness direction z, allowing the top surface 130 to be exposed. In the present embodiment, the protective resin 8 covers portions of the wiring members 92.

The following describes an example of a method for manufacturing the thermal print head A1, with reference to FIGS. 5 to 11.

First, a semiconductor substrate material is prepared. The semiconductor substrate material is made of a low resistant semiconductor material, such as Si doped with a metallic element. The semiconductor substrate material has a (100) surface. After the (100) surface is covered with a predetermined mask layer, anisotropic etching with KOH is performed. This yields the semiconductor substrate 1 shown in FIG. 5. The obverse surface 11 and the top surface 130 are (100) surfaces. Each of the first inclined side surface 131 and the second inclined side surface 132 is an inclined surface formed by anisotropic etching, and forms an angle of 54.7° with the obverse surface 11. Note that a different method such as cutting may be employed to form the semiconductor substrate 1.

Figure 6:
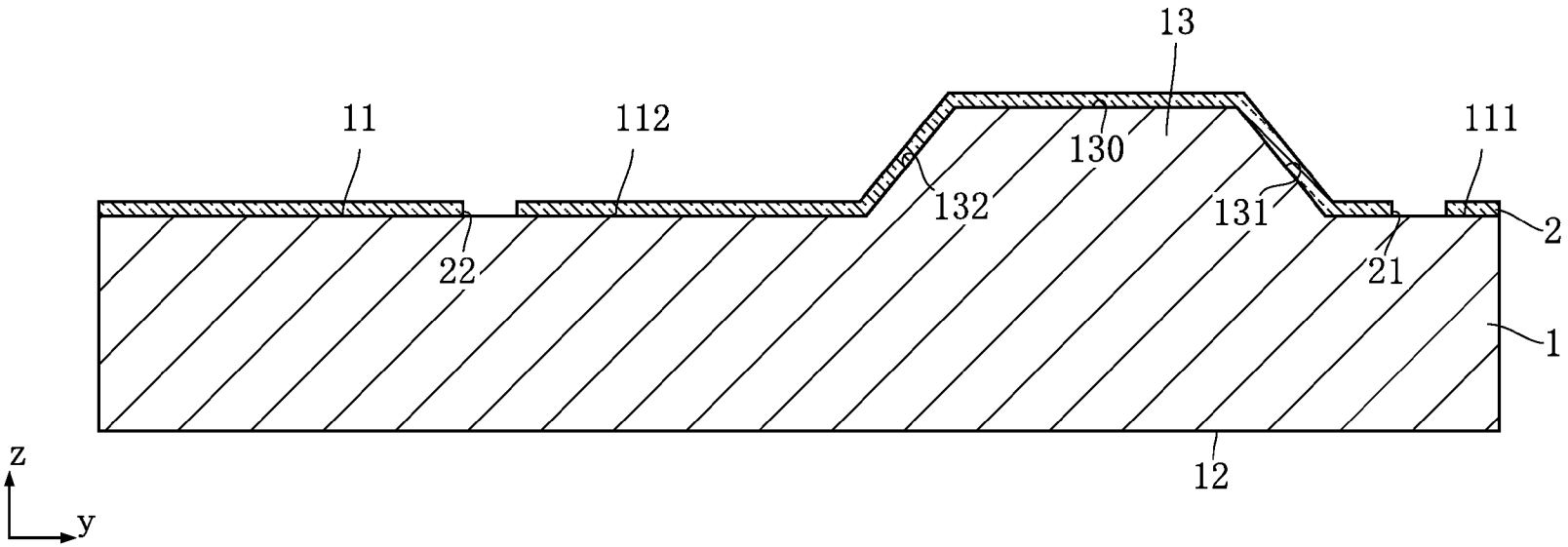
FIG. 6 is an enlarged cross-sectional view showing an example of the method for manufacturing the thermal print head in FIG. 1.

Next, the insulation layer 2 is formed as shown in FIG. 6. The insulation layer 2 may be formed by depositing $SiO_2$ through CVD. Also, the common-electrode first opening 21 and the common-electrode second opening 22 are formed by etching or the like.

Figure 7:
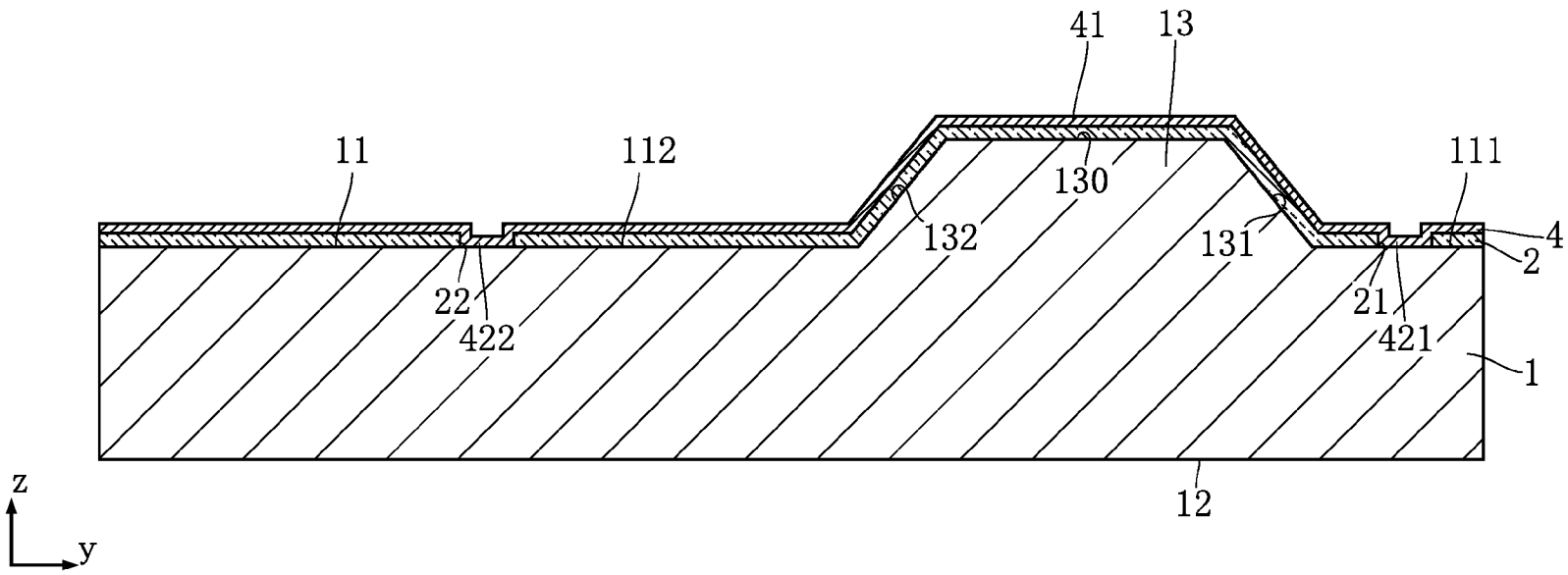
FIG. 7 is an enlarged cross-sectional view showing an example of the method for manufacturing the thermal print head in FIG. 1.
Figure 8:
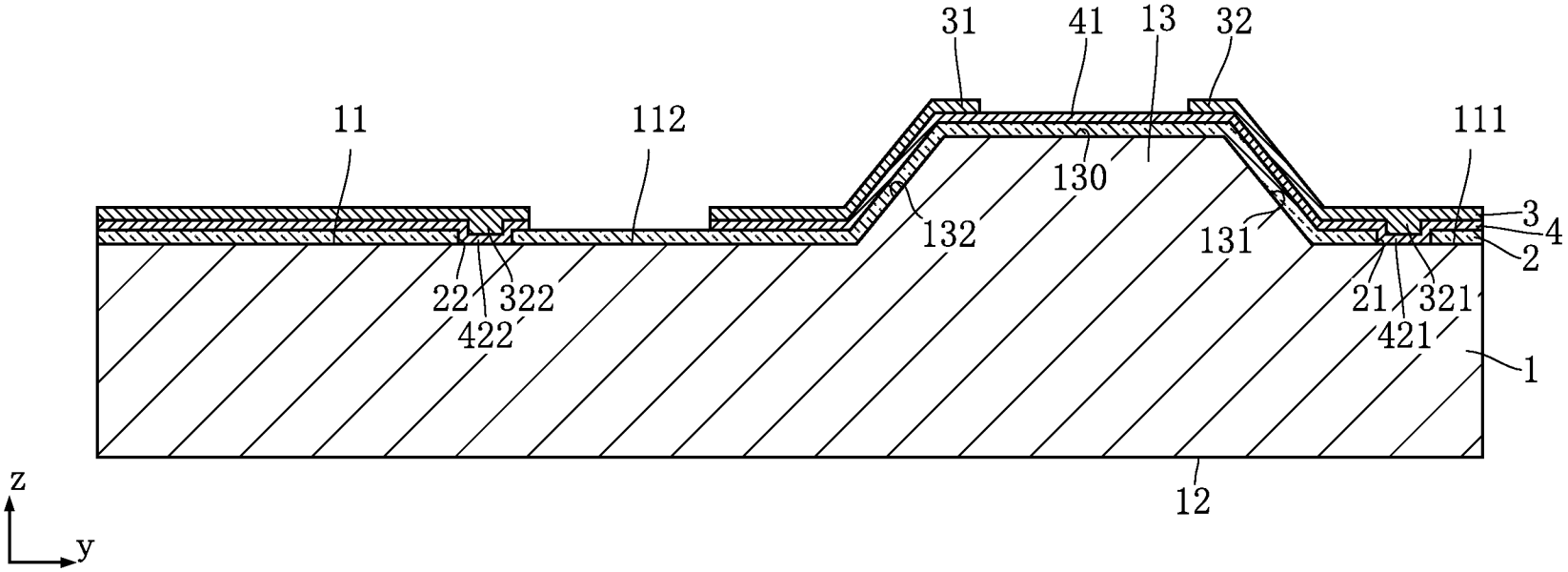
FIG. 8 is an enlarged cross-sectional view showing an example of the method for manufacturing the thermal print head in FIG. 1.

Next, the resistor layer 4 is formed as shown in FIG. 7. The resistor layer 4 is formed by forming a thin TaN film on the insulation layer 2 through sputtering, for example.

Next, the wiring layer 3 is formed to cover the resistor layer 4. The wiring layer 3 is formed by forming a Cu layer through plating or sputtering, for example. Note that a Ti layer may be formed before forming the Cu layer. Subsequently, the wiring layer 3 and the resistor layer 4 are selectively etched to yield the wiring layer 3 and the resistor layer 4 shown in FIG. 8. The wiring layer 3 has the plurality of individual electrodes 31 and the common electrode 32. The resistor layer 4 has the plurality of heat generating portions 41. The common electrode 32 has the wiring-side first through-conductive portion 321 and the wiring-side second through-conductive portion 322. The resistor layer 4 has the resistor-side first through-conductive portion 421 and the resistor-side second through-conductive portion 422.

Figure 9:
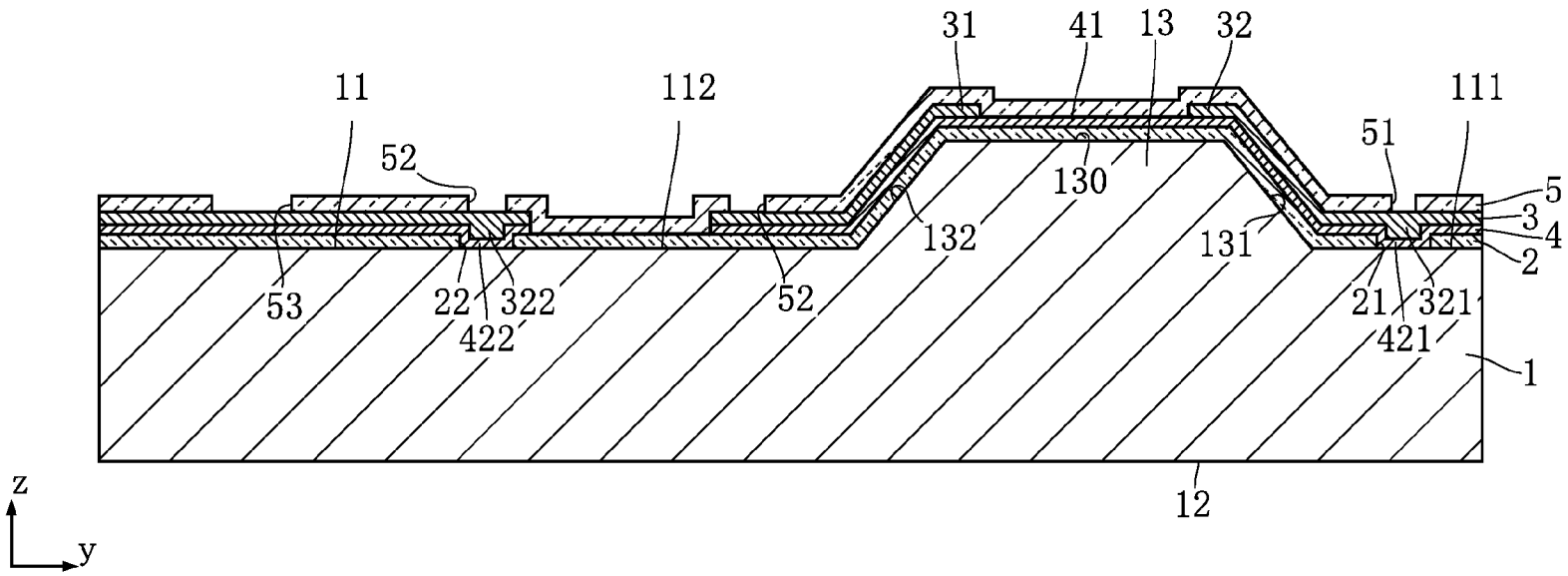
FIG. 9 is an enlarged cross-sectional view showing an example of the method for manufacturing the thermal print head in FIG. 1.

Next, the insulating protective layer 5 is formed as shown in FIG. 9. The insulating protective layer 5 may be formed, for example, by depositing $SiO_2$ on the insulation layer 2, the wiring layer 3, and the resistor layer 4 through CVD and then performing etching.

Figure 10:
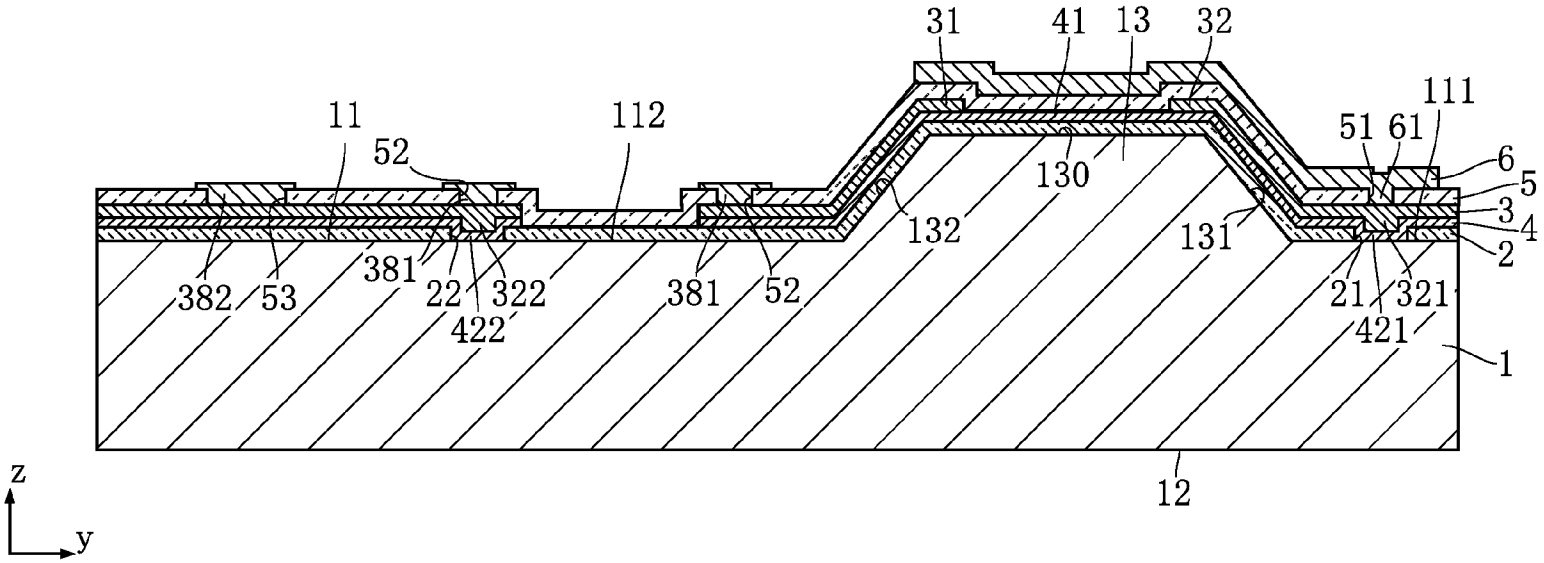
FIG. 10 is an enlarged cross-sectional view showing an example of the method for manufacturing the thermal print head in FIG. 1.
Figure 11:
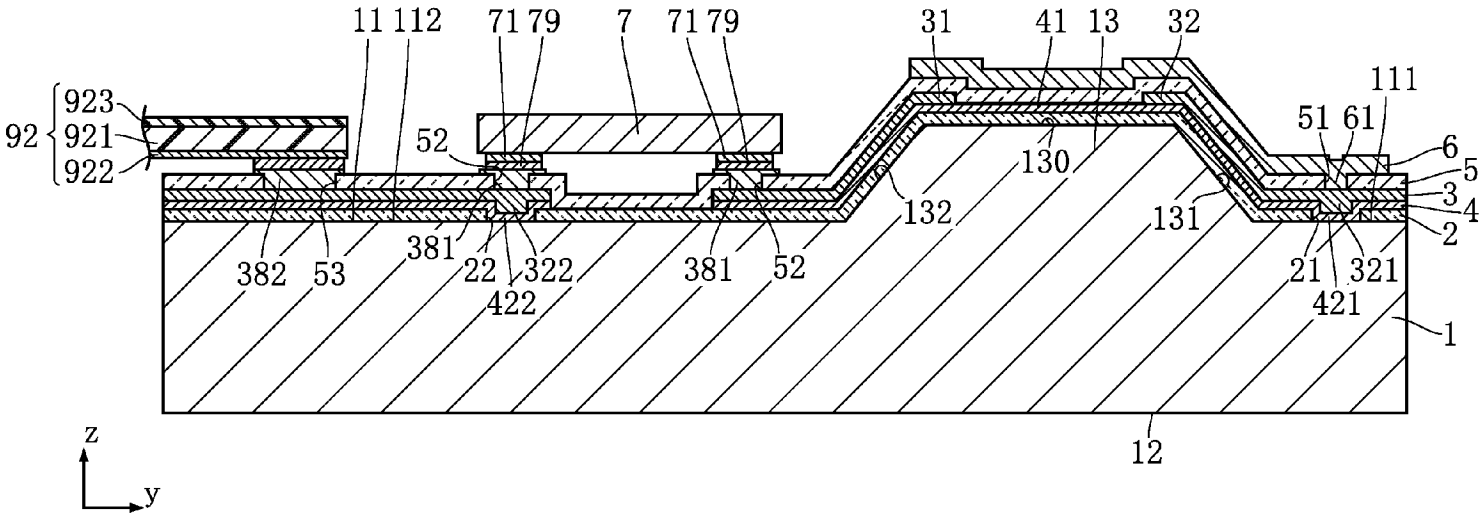
FIG. 11 is an enlarged cross-sectional view showing an example of the method for manufacturing the thermal print head in FIG. 1.

Next, the conductive protective layer 6 is formed as shown in FIG. 10. Also, the control element pads 381 and the wiring member pad 382 are formed. Next, the wiring member 92 is bonded to the wiring member pad 382 as shown in FIG. 11. Subsequently, the semiconductor substrate 1 is bonded to the supporting member 91 with use of the bonding layer 919, and then the protective resin 8 is formed. These steps as described above are performed to form the thermal print head A1.

Next, the advantages of the thermal print head A1 will be described.

According to the present embodiment, the conduction path for energizing the heat generating portions 41 includes the semiconductor substrate 1 itself. Energization by using the semiconductor substrate 1 as a conduction path eliminates the need to form an equivalent energizing portion in the wiring layer 3. Thus, the total area of the wiring layer 3 to be disposed on the obverse surface 11 can be reduced and hence a larger area is ensured for the wiring layer 3 on the obverse surface 11. As a result, the wiring layer 3 on the obverse surface 11 can be formed more readily (e.g., with a greater degree of freedom in design) in response to the downsizing and pitch-narrowing of the heat generating portions 41. As such, fine printing will also be achieved.

The semiconductor substrate 1 is electrically connected to the common electrode 32. The common electrode 32 is electrically connected to all of the heat generating portions 41. This eliminates needs such as to divide the semiconductor substrate 1 into a plurality of portions that are insulated from each other.

The semiconductor substrate 1 is in contact with the wiring-side first through-conductive portion 321 and the wiring-side second through-conductive portion 322 via the common-electrode first opening 21 and the common-electrode second opening 22. The common-electrode first opening 21 and the common-electrode second opening 22 sandwich the heat generating portions 41 in the sub-scanning direction y. Similarly, the wiring-side first through-conductive portion 321 and the wiring-side second through-conductive portion 322 sandwich the heat generating portions 41 in the sub-scanning direction y. With such an arrangement, a portion of the conduction path formed by the semiconductor substrate 1 bypasses the heat generating portions 41 in the thickness direction z. This is suitable in downsizing and pitch-narrowing of the heat generating portions 41.

Furthermore, the portion of the conduction path formed by the semiconductor substrate 1 overlaps with the plurality of control elements 7 as viewed in the thickness direction z. This suppresses interference between the wiring layer 3 and the plurality of control elements 7.

The common-electrode first opening 21 is elongated in the main scanning direction x. This reduces contact resistance between the wiring layer 3 and the semiconductor substrate 1.

The insulating protective layer 5 is electrically connected to the common electrode 32 of the wiring layer 3 via the protective layer through-conductive portion 61. The insulating protective layer 5 rubs against the printing medium 992, and therefore is likely to build up static charges. These static charges can be appropriately released to the common electrode 32 of the wiring layer 3.

The semiconductor substrate 1 has the projection 13, and the heat generating portions 41 are provided at locations overlapping with the projection 13 as viewed in the thickness direction z. This arrangement allows the heat generating portions 41 to be pressed against the printing medium 992 with a high pressing force, which is suitable for realizing fine printing.

As described above, the projection 13 has the top surface 130, the first inclined side surface 131, and the second inclined side surface 132. The top surface 130 is a flat surface parallel to the obverse surface 11 and suitable as a portion for forming the heat generating portions 41 on it. The structure including the first inclined side surface 131 and the second inclined side surface 132 is suitable for forming the wiring layer 3 and the resistor layer 4 in such a manner as to span the projection 13.

The control elements 7 are arranged at the second region 112 and located closer to the obverse surface 11 in the thickness direction z than the conductive protective layer surface S6 is. This arrangement prevents the interference between the control elements 7 and the printing medium 992. In addition, the control elements 7 are located closer to the obverse surface 11 in the thickness direction z than the resistor layer surface S4 is. This arrangement more reliably prevents the interference between the control elements 7 and the printing medium 992.

Figure 12:
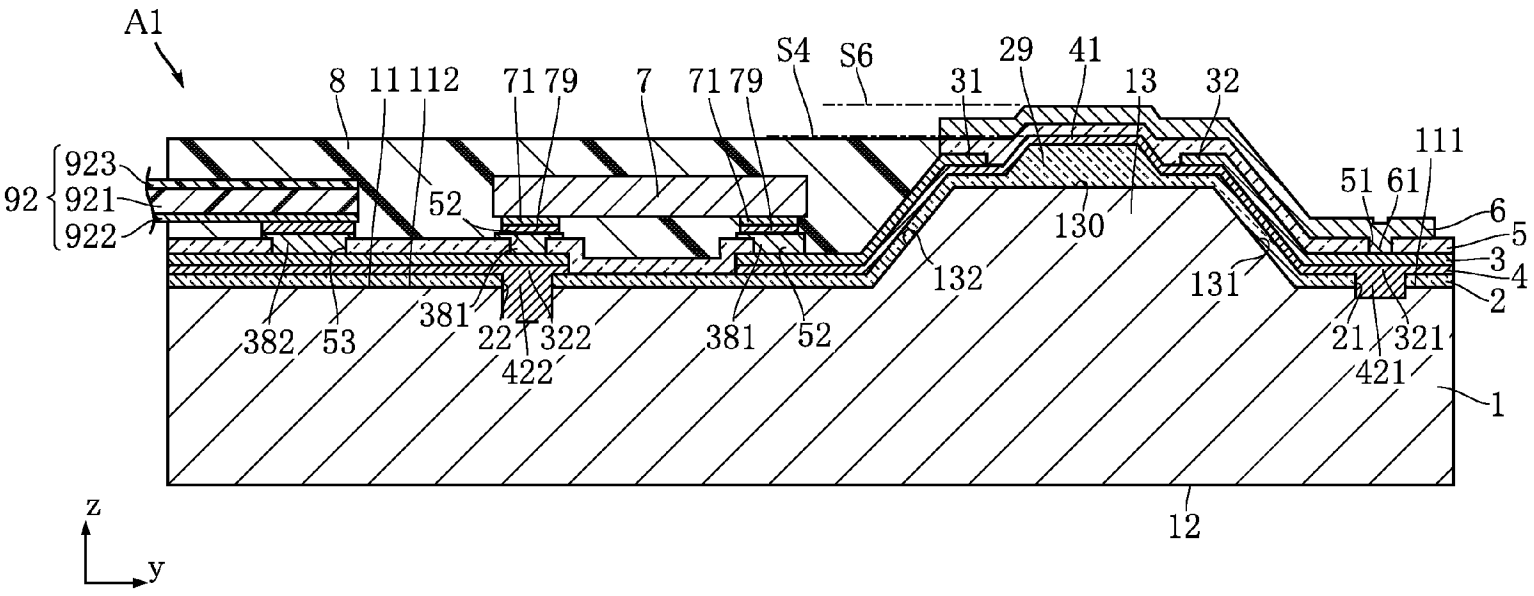
FIG. 12 is an enlarged cross-sectional view showing a variation of the thermal print head in FIG. 1.
Figure 13:
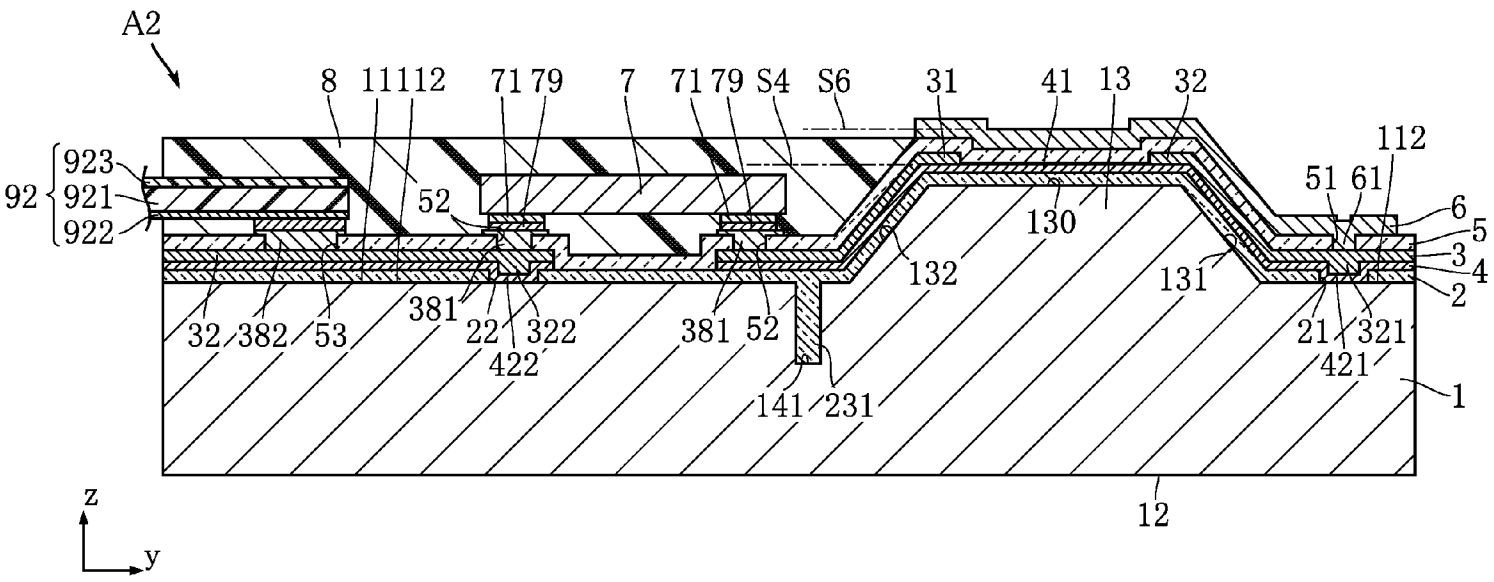
FIG. 13 is an enlarged cross-sectional view showing a thermal print head according to a second embodiment of the present invention.
Figure 14:
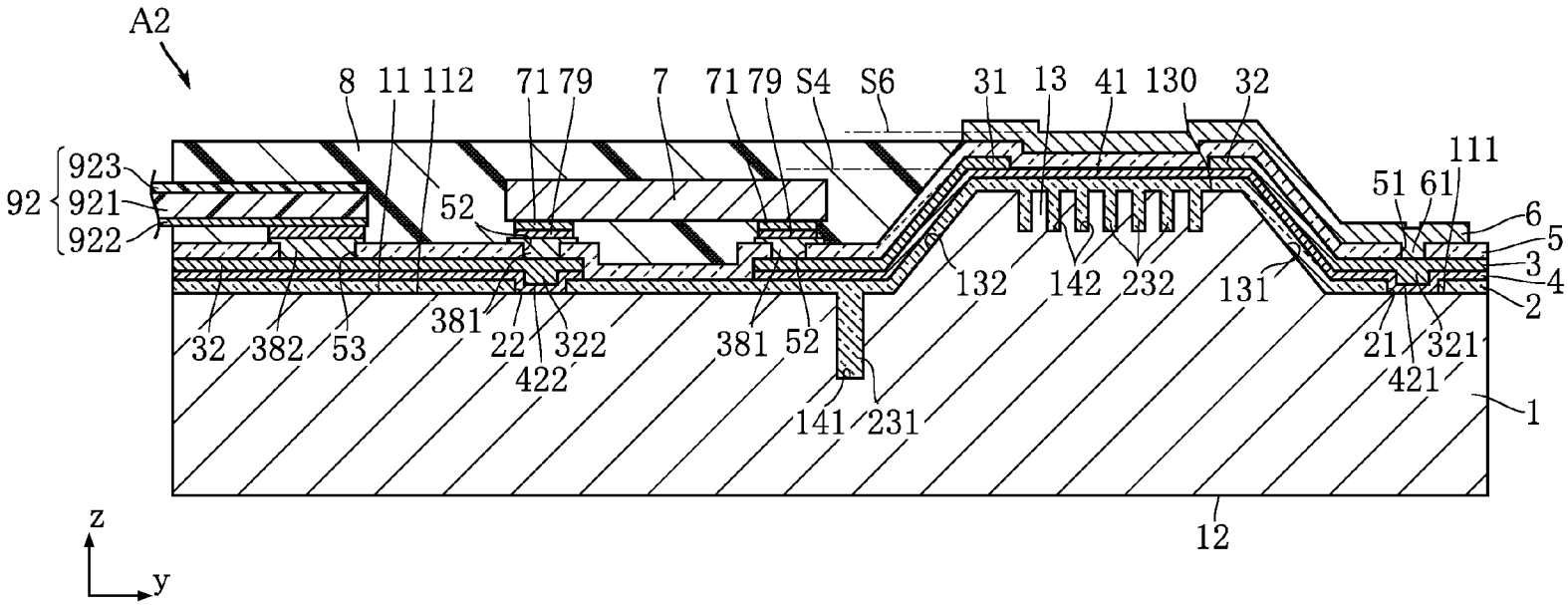
FIG. 14 is an enlarged cross-sectional view showing a main part of the thermal print in FIG. 13.

FIGS. 12-14 show variations and other embodiments of the present invention. In these figures, the elements that are the same as or similar to the above embodiment are provided with the same reference signs as the above embodiment.

FIG. 12 shows a variation of the thermal print head A1. In this variation, the insulating layer 2 has a raised portion 29. The raised portion 29 is formed on the top surface 130 of the projection 13. The raised portion 29 is thicker than other portions of the insulating layer 2 and elongated in the main scanning direction x. The heat generating portions 41 of the resistor layer 4 are on the raised portion 29.

FIG. 13 shows a thermal print head according to a second embodiment of the present invention. The thermal print head A2 of the present embodiment differs from the above-described thermal print head A1 in structure of the semiconductor substrate 1 and insulating layer 2.

In the present embodiment, the semiconductor substrate 1 has a heat-conduction-preventing first recess 141. The heat-conduction-preventing first recess 141 is recessed from the obverse surface 11 toward the reverse surface 12. The heat-conduction-preventing first recess 141 is not particularly limited in terms of shape, and is elongated in the main scanning direction x in the present embodiment. The heat-conduction-preventing first recess 141 is formed at the second region 112 of the obverse surface 11.

The insulating layer 2 has a first recess-filling portion 231. The first recess-filling portion 231 fills the heat-conduction-preventing first recess 141.

This embodiment is also suitable for achieving fine printing. Specifically, the heat-conduction-preventing first recess 141 is located between the heat generating portions 41 and the control element electrodes 71 of the control elements 7 in the sub-scanning direction y. Thus, the heat-conduction-preventing first recess 141 serves to reduce heat conduction from the heat generating portions 41 to the control elements 7 or the wiring member 92 via the semiconductor substrate 1. Although the semiconductor substrate 1, which is made of a semiconductor material such as Si, has a relatively high heat conductivity, the present embodiment reduces undesirable heat conduction through the semiconductor substrate 1 to the control elements 7 or the wiring member 92.

FIG. 14 shows a variation of the thermal print head A2. In this variation, the semiconductor substrate 1 has a plurality of heat-conduction-preventing second recesses 142. The heat-conduction-preventing second recesses 142 are recessed from the top surface 130 of the projection 13 toward the reverse surface 12. The insulating layer 2 has a plurality of second recess-filling portions 232. The second recess-filling portions 232 fill the heat-conduction-preventing second recesses 142. The heat generating portions 41 overlap with the heat-conduction-preventing second recesses 142 and the second recess-filling portions 232 as viewed in the thickness direction z.

This embodiment is also suitable for achieving fine printing. The heat-conduction-preventing second recesses 142 serve to reduce heat conduction from the heat generating portions 41 to the semiconductor substrate 1. The heat conduction to the semiconductor substrate 1 is more reliably reduced by filling the heat-conduction-preventing second recesses 142 with the second recess-filling portions 232.

The thermal print head of the present invention is not limited to those described in the above embodiments. Various design changes can be made to the specific configurations of the elements of the thermal print head according to the present invention.

The invention claimed is:

1. A thermal print head comprising:

a semiconductor substrate;

a resistor layer formed on the semiconductor substrate and having a plurality of heat generating portions arranged in a main scanning direction;

a wiring layer formed on the semiconductor substrate and included in a conduction path for energizing the plurality of heat generating portions;

an insulating protective layer covering the wiring layer and the resistor layer; and an insulation layer formed on the semiconductor substrate, wherein the conduction path includes the semiconductor substrate, the wiring layer includes a plurality of individual electrodes and a common electrode, the plurality of individual electrodes being connected to the plurality of heat generating portions, respectively, the common electrode includes a portion arranged opposite to the plurality of individual electrodes with respect to the plurality of heat generating portions, the common electrode being electrically connected to the plurality of heat generating portions, and the common electrode being electrically connected to the semiconductor substrate, the insulation layer is formed with a common-electrode first opening for electrically connecting the semiconductor substrate to the common electrode, and formed with a common-electrode second opening opposite to the common-electrode first opening with respect to the plurality of heat generating portions in a sub-scanning direction for electrically connecting the semiconductor substrate to the common electrode, the resistor layer includes a resistor-side second through-conductive portion held in contact with the semiconductor substrate via the common-electrode second opening.

2. The thermal print head according to claim 1, wherein the common-electrode first opening is elongated in the main scanning direction.

3. The thermal print head according to claim 1, wherein the resistor layer includes a resistor-side first through-conductive portion held in contact with the semiconductor substrate via the common-electrode first opening.

4. The thermal print head according to claim 3, wherein the common electrode includes a wiring-side first through-conductive portion held in contact with the resistor-side first through-conductive portion.

5. The thermal print head according to claim 1, wherein the semiconductor substrate is made of Si doped with a metallic element.

6. The thermal print head according to claim 1, wherein the resistor layer is made of TaN.

7. The thermal print head according to claim 1, wherein the wiring layer is made of Cu.

8. The thermal print head according to claim 1, wherein the common electrode includes a wiring-side second through-conductive portion held in contact with the resistor-side second through-conductive portion.

9. The thermal print head according to 8, further comprising a plurality of control elements that are electrically connected to the wiring layer for individually energizing the plurality of heat generating portions.

10. The thermal print head according to claim 9, wherein the common-electrode second opening overlaps with the control elements as viewed in the thickness direction.

11. The thermal print head according to claim 9, wherein the insulating protective layer is formed with control element openings that partially expose the plurality of individual electrodes or the common electrode.

12. The thermal print head according to claim 11, further comprising control element pads formed in the control element openings.

13. The thermal print head according to claim 12, wherein the control elements are conductively bonded to the control element pads.

14. The thermal print head according to claim 9, wherein the insulating protective layer is formed with a wiring member opening opposite to the plurality of heat generating portions with respect to the control elements in the sub-scanning direction for exposing the wiring layer.

15. The thermal print head according to claim 14, further comprising a wiring member pad formed in the wiring member opening.

16. The thermal print head according to claim 15, further comprising a wiring member bonded to the wiring member pad.

17. The thermal print head according to claim 16, wherein the wiring member comprises a flexible wiring board.

18. The thermal print head according to claim 9, wherein the semiconductor substrate includes: an obverse surface and a reverse surface that face away from each other in a thickness direction; and a projection projecting from the obverse surface in the thickness direction and elongated in the main scanning direction, and the heat generating portions overlap with the projection as viewed in the thickness direction.

19. The thermal print head according to claim 18, wherein the obverse surface includes a first region and a second region spaced apart from each other in the sub-scanning direction with the projection intervening therebetween.

20. The thermal print head according to claim 19, wherein the projection includes: a top surface parallel to the obverse surface and spaced apart from the obverse surface in the thickness direction; a first inclined side surface located between the top surface and the first region and inclined relative to the obverse surface; and a second inclined side surface located between the top surface and the second region and inclined relative to the obverse surface.

21. The thermal print head according to claim 20, wherein the heat generating portions overlap with the top surface as viewed in the thickness direction.

22. The thermal print head according to claim 21, wherein the common-electrode first opening overlaps with the first region as viewed in the thickness direction.

23. The thermal print head according to claim 22, wherein the common-electrode second opening overlaps with the second region as viewed in the thickness direction.

24. The thermal print head according to claim 23, wherein the control elements overlap with the second region as viewed in the thickness direction.

25. The thermal print head according to claim 20, further comprising a conductive protective layer that overlaps with the plurality of heat generating portions as viewed in the thickness direction and is formed on the insulating protective layer.

26. The thermal print head according to claim 25, wherein the conductive protective layer is made of TiN.

27. The thermal print head according to claim 26, wherein the insulating protective layer is formed with a conductive-protective-layer opening for electrically connecting the conductive protective layer to the common electrode.

28. The thermal print head according to claim 27, wherein the conductive protective layer includes a protective layer through-conductive portion held in contact with the common electrode via the conductive-protective-layer opening.

29. The thermal print head according to claim 28, wherein the conductive-protective-layer opening overlaps with the first region as viewed in the thickness direction.

30. The thermal print head according to claim 20, wherein the semiconductor substrate includes a heat-conduction-preventing first recess that is recessed from the obverse surface toward the reverse surface.

31. The thermal print head according to claim 30, wherein the heat-conduction-preventing first recess is elongated in the main scanning direction.

32. The thermal print head according to claim 30, wherein the heat-conduction-preventing first recess is at the second region.

33. The thermal print head according to claim 30, wherein the insulating layer includes a first recess-filling portion that fills the heat-conduction-preventing first recess.

34. The thermal print head according to claim 30, wherein the semiconductor substrate includes a heat-conduction-preventing second recess that is recessed from the top surface.

35. The thermal print head according to claim 34, wherein the insulating layer includes a second recess-filling portion that fills the heat-conduction-preventing second recess.

* * * * *